US006579035B1

(12) United States Patent
Watson

(10) Patent No.: US 6,579,035 B1
(45) Date of Patent: Jun. 17, 2003

(54) TRAFFIC WARNING DEVICE AND METHOD OF USE

(76) Inventor: Ted J. Watson, 27834 Dexter Dr., Saugus, CA (US) 91350

( * ) Notice: Subject to any disclaimer, the term of this patent is extended or adjusted under 35 U.S.C. 154(b) by 0 days.

(21) Appl. No.: 09/934,217

(22) Filed: Aug. 21, 2001

(51) Int. Cl.[7] ..... E01F 9/093; E01F 9/053

(52) U.S. Cl. ..... 404/14; 404/9; 404/12

(58) Field of Search ..... 404/9, 12, 13, 404/14, 15, 16; 116/63 R, 63 P; D10/113

(56) References Cited

U.S. PATENT DOCUMENTS

| | | | | | |
|---|---|---|---|---|---|
| 1,599,975 | A | * | 9/1926 | Peterson | 404/14 |
| 1,707,432 | A | * | 4/1929 | Erickson | 404/14 |
| 1,910,791 | A | * | 5/1933 | Coppel | 404/14 |
| 2,046,321 | A | * | 7/1936 | Burkhardt | 88/79 |
| 2,700,754 | A | * | 1/1955 | McCullough | 340/116 |
| 3,334,554 | A | * | 8/1967 | Adams | 94/1.5 |
| 3,485,148 | A | * | 12/1969 | Heenan | 94/1.5 |
| 3,758,191 | A | * | 9/1973 | Hedgewick | 350/103 |
| 3,785,719 | A | * | 1/1974 | Jonnes | 350/105 |
| 3,996,556 | A | * | 12/1976 | Eienmann | 340/117 |
| 4,050,834 | A | * | 9/1977 | Lee | 404/16 |
| D256,898 | S | * | 9/1980 | Barr | D10/6 |
| 4,232,979 | A | * | 11/1980 | Johnson, Jr. et al. | 404/16 |
| 4,428,320 | A | * | 1/1984 | Oplt et al. | 116/63 R |
| 4,594,021 | A | * | 6/1986 | Schafer et al. | 404/14 |
| 4,626,127 | A | * | 12/1986 | May | 404/14 |
| 4,668,120 | A | * | 5/1987 | Roberts | 404/12 |
| 4,687,369 | A | * | 8/1987 | McDonald | 404/12 |
| 5,242,242 | A | * | 9/1993 | Young | 404/12 |
| D354,246 | S | * | 1/1995 | Weid | D10/113 |
| 5,425,596 | A | * | 6/1995 | Steere et al. | 404/14 |
| 5,515,807 | A | * | 5/1996 | Speer et al. | 116/63 P |
| 5,667,334 | A | * | 9/1997 | Boyce | 404/9 |
| 5,667,335 | A | * | 9/1997 | Kheiu et al. | 404/14 |
| 5,680,033 | A | * | 10/1997 | Cha | 320/61 |
| 5,816,737 | A | * | 10/1998 | Siblik | 404/13 |
| 5,984,570 | A | * | 11/1999 | Parashar | 404/14 |
| D422,932 | S | * | 4/2000 | Khieu et al. | D10/113 |
| D425,440 | S | * | 5/2000 | Franklin | D10/113 |
| 6,334,734 | B1 | * | 1/2002 | Attar | 404/16 |
| 6,347,906 | B2 | * | 2/2002 | Schuler | 404/16 |

* cited by examiner

*Primary Examiner*—Thomas B. Will
*Assistant Examiner*—Kristine Florio
(74) *Attorney, Agent, or Firm*—Ted Masters

(57) ABSTRACT

A traffic warning device for temporary placement upon the surface of a road includes a single elongated body with a first side having a reflector, and a second side and top having a bright color such as international orange. The shape and size of the traffic warning device are specifically designed to resist turning over when struck by a vehicle tire. When traffic warning device is placed prone, bottom down, upon the surface of the road, the first and second sides form an elongate barrier which extends along the surface of the road, thereby alerting a motorist to a road obstruction. The present invention comprises a safe, one time deployment of reusable barricades, thus eliminating the need to use conventional highway flares which burn hazardous materials.

3 Claims, 7 Drawing Sheets

TRAFFIC WARNING DEVICE AND METHOD OF USE

TECHNICAL FIELD

The present invention pertains to traffic warning devices which are temporarily set out on the surface of a road to warn approaching vehicular or pedestrian traffic of an obstruction.

BACKGROUND OF THE INVENTION

It is common practice for law enforcement officers to carry highway flares and or orange traffic cones in their police vehicles, typically sedans and motorcycles. The trunk of the sedan is used to store and transport both the flares and the cones, however the limited cargo space of motorcycle saddle bags can only accommodate the flares. Slow burning red pyrotechnic highway flares are recognized internationally as an established means for law enforcement officers to guide or direct motor vehicles, bicycles, pedestrians, and aircraft. However, these devices have numerous disadvantages. To wit: they have a limited shelf life; they are susceptible to moisture damage; they are highly flammable and therefore can cause accidental burns; they emit hazardous materials and noxious flumes of smoke into the environment; they can ignite oil, gasoline, or even vegetation at the site of an accident; once lit, they are difficult to extinguish; they have a short life and can therefore burn out when they are still needed; and, they can be used by unlawful parties to start fires. In view of the aforementioned disadvantages, there is needed a replacement device which will accomplish the same function, but which does not possess the many objectionable features of the conventional highway flare.

Roadway surface marking and warning devices have been known in the art for many years. These devices fall into two basic categories, permanently installed and temporarily placed. Permanently installed pavement lane markers are typical of the former category, while emergency warning devices such as flares are typical of the later. For example;

U.S. Pat. No. 2,887,930 illustrates a multisided emergency warning signal marker having a light reflecting area on each of its sides. The marker is used to provide a temporary warning of disabled trucks, cars, and the like. The marker can be rolled or tumbled into position on any side.

U.S. Pat. No. 3,528,370 shows a fusee having a no-roll device. A fusee cap includes a tubular sheath having a scratch mix thereon and covered with a lid. A post-like projection extends from the tubular sheath in a direction substantially perpendicular to the axis thereof to provide a no-roll feature.

U.S. Pat. No. 3,596,627 illustrates a portable warning device having a heavy base of steel rod formed into a polygon. The rod has portion, extending into the polygon, to which is pivotally secured to a reflector.

U.S. Pat. No. 3,625,177 defines a portable emergency warning apparatus which includes a foldable triangular-shaped warning portion in which one side of the triangle has pads thereon to act as a portion of the base. A removable base member has a pair of feet attached between the ends of the side having pads thereon, whereby the base can be easily removed and the triangular portion folded for easy storage.

U.S. Pat. No. 3,934,541 depicts a triangular folding reflective traffic marker. The marker comprises a reflective base member and a pair of reflective side member which are pivotally connected to opposite ends of the base member and are swingable between folded and erected positions.

U.S. Pat. No. 3,934,542 discloses a triangular folding reflective flare having a weighted base. A reflective lower member is connected to two reflective side members which move between folded and erect positions.

U.S. Pat. No. 3,954,324 comprises a pavement marker having conical retro-reflectors. The marker includes a housing having a base for engagement with the surface of the roadway and a reflective wall for reflecting light from vehicles on the roadway when the fore-and-aft axis of the housing is disposed in parallel relationship with the direction of travel of vehicles on the roadway.

U.S. Pat. No. 3,971,623 consists of a fixed roadway marker having a shell-like body with a chamber formed therein. The body is at least partially transparent to form a transparent outer wall for the chamber so that the interior of the chamber is visible. Either daytime or nighttime marker elements, or both, may be provided in the chamber.

U.S. Pat. No. 4,340,319 shows a pavement marker for engagement with an underlying. roadway for providing a marking visible from an oncoming vehicle on the roadway surface. The pavement marker comprises a lens member of light-transmitting synthetic resin, and a rear face having reflex reflective means for reflecting light transmitted through a light-receiving and refracting portion back to the source.

U.S. Pat. No. 4,864,299 pertains to a vertically-arranged transportable traffic guide beacon. The beacon is made of high impact-resistant thermoplastic resin or an elastomer. After bending, the beacon can be bend back to assume its original shape.

U.S. Pat. No. 4,890,203 defines a hand-held identity light of cylindrical construction which contains a battery compartment. The device is used to signal, control crowds, and illuminate dark areas.

U.S. Pat. No. 5,002,424 depicts a reflective pavement marker with inclined reinforcing ribs. The device has a shell-like housing of synthetic resin or other moldable-material with reflective end walls of light transmitting material and a filler of epoxy or other potting material.

U.S. Pat. No. 5,122,781 discloses a hazard warning light for use in place of a conventional flare. The device has a lamp assembly using a long shelf life battery to over-run light emitting diodes under control of a low duty cycle low frequency oscillator. The warning light is vertically mounted on a tripod assembly.

U.S. Pat. No. 5,199,375 describe a folding warning marker. The marker includes three tubular stays each having first upper ends joined together by torsional coil springs. A flexible, brightly colored and reflective fabric cover is received over the stays.

SUMMARY OF THE INVENTION

The present invention is directed to a traffic warning device which replaces the conventional slow burning red pyrotechnic flare. The traffic warning device is nonflammable, environmentally friendly, portable, durable, reusable, light weight, contoured to resist tipping over, aerodynamically designed to resist movement by the wind, and economical. It may be utilized by law enforcement agencies, the military, fire departments, departments of public works, construction companies, and private parties to warn or direct oncoming vehicular and pedestrian traffic of a road obstruction or emergency situation such as an accident, a disabled vehicle, a pothole, debris, road construction, a road block, etc. A preferred name for the present invention is ROADLIGHT.

The present invention has one side which contains reflectors for use at night. The opposite side and top are a bright color such as "international orange", and are suitable for daytime use. The reflector side also has a light which is useful for warning vehicles without headlights and pedestrians. The traffic warning devices may be laid out in what ever type of configuration needed to direct traffic around an obstruction in the roadway. When so deployed, the present invention provides a highly visible barrier, much like that of bright orange cones.

The present invention will make a Police Officer's job much easier and safer. It may in fact even save an Officer from being seriously injured or killed. One of the most dangerous functions an officer is required to perform is trying to divert vehicular traffic around an obstruction in the roadway, a function that results in Police Officers being seriously injured and killed every year. As flares burn out, an Officer has to continually reenter the roadway to ignite new flares. The present invention on the other hand is a one time deployment, which immediately reduces the amount of time an Officer spends in harm's way from approaching vehicles.

The present invention is environmentally friendly, and will not start accidental fires, thus eliminating potential harm to humans, animals, and property.

In accordance with a preferred embodiment of the invention, a traffic warning device for temporary placement upon the surface of a road includes a single elongated structure having a top, an opposite bottom, a first side, and opposite second side, a length, a width, a height, and two opposite beveled ends. To ensure stability, the width is greater than the height. A reflector is disposed on the first side, and a bright color, such as international orange, is disposed on the second side and the top. When the traffic warning device is placed prone, bottom down, upon the surface of the road, the first and second sides form an elongate visual barrier which extends horizontally along the surface of the road. The elongate visual barrier notifies a motorist of a traffic problem.

In accordance with an important aspect of the invention, the beveled ends are configured so that the bottom is larger than the top, so that when said traffic warning device is run over by a tire, said traffic warning device will resist tipping over.

In accordance with an important feature of the invention, the top forms an edge with each of the first and second sides, the edges being rounded, so that when the traffic warning device is run over by a tire, the traffic warning device will resist tipping over.

In accordance with another important aspect of the invention, for protection, the reflectors are recessed into the first side.

In accordance with another important feature of the invention, the second side includes at least one recessed removable panel.

In accordance with another important aspect of the invention, a selectively energizable red light is disposed on the first side.

Other features and advantages of the present invention will become apparent from the following detailed description, taken in conjunction with the accompanying drawings, which illustrate, by way of example, the principles of the invention.

DETAILED DESCRIPTION OF THE INVENTION

Figure 1:
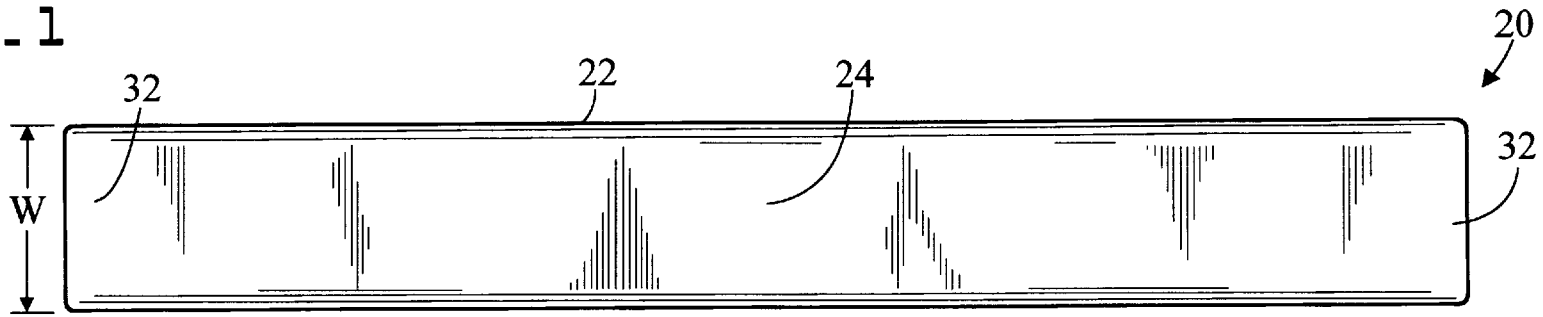
FIG. 1 is a top plan view of a traffic warning device in accordance with the present invention.
Figure 2:
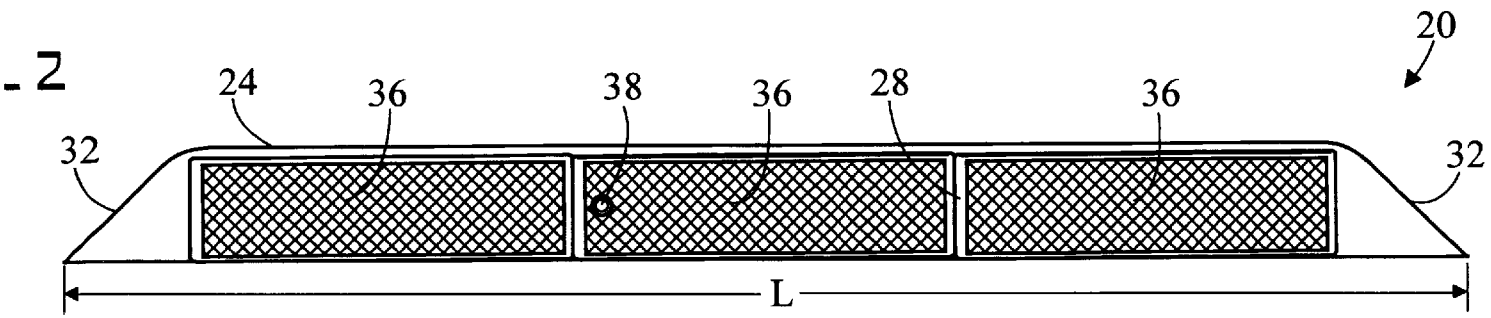
FIG. 2 is a first side elevation view.
Figure 3:
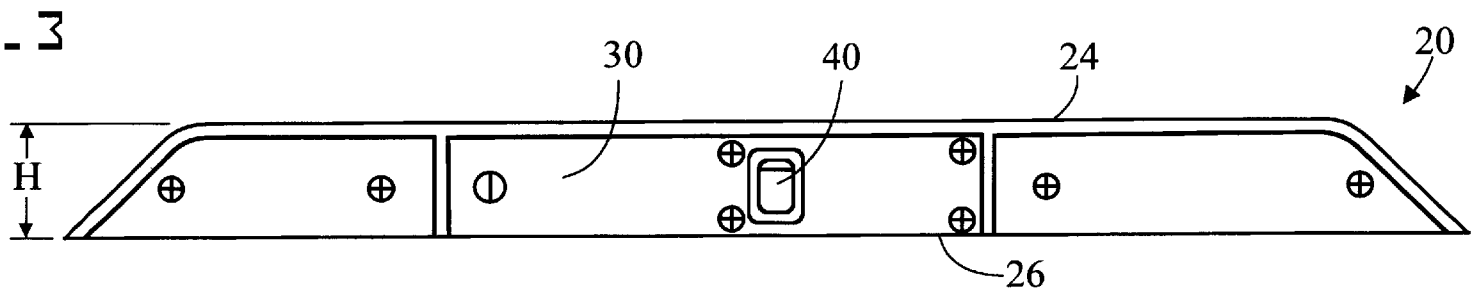
FIG. 3 is a second side elevation view.
Figure 4:
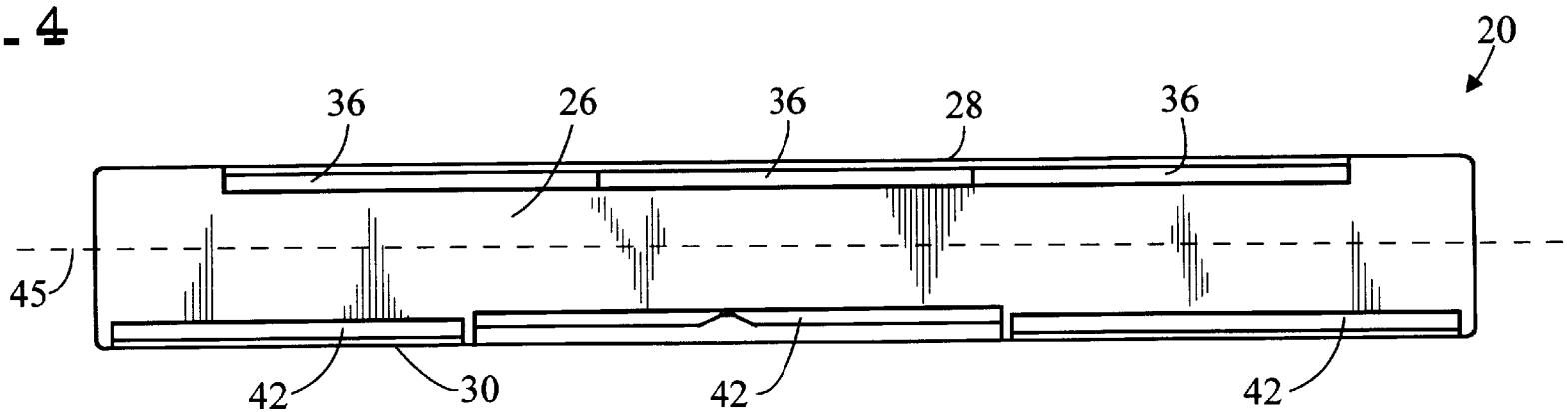
FIG. 4 is a bottom plan view.

Referring initially to FIGS. 1–5, and 7–9, there are illustrated top plan, first side elevation, second side elevation, bottom plan, end elevation, first side perspective, and second side perspective views respectively of a traffic warning device for temporary placement upon the surface of a road 500 in accordance with the present invention, generally designated as 20. Traffic device 20 has an elongate body 22 having a top 24, an opposite bottom 26, a first side 28, and opposite second side 30, a length L, a width W, a height H, and two opposite beveled ends 32. First side 28 and second side 30 are substantially perpendicular to bottom 26. It is important to note that traffic device 20 is a single elongate substantially board-shaped structure. That is, traffic device 20, including all of its parts, only defines an elongated substantially rectangular structure that specifically does not have any attached external structural members or elements. Beveled ends 32 are configured so that bottom 26 is larger than top 24, so that when traffic warning device 20 is run over by a tire 600, traffic warning device 20 will resist tipping over (refer also to FIGS. 10 and 11). It is also important to note that width W is greater than height H. This is to give traffic warning device 20 stability and to prevent traffic warning device 20 from tipping over when run over by a tire 600. Height H however must be sufficient to be visible to an approaching motorist. It is also noted that top 24 forms an edge 34 with each of first 28 and second 30 sides. The edges 34 are rounded, so that when traffic warning device 20 is run over by a tire 600, traffic warning device 20 will resist tipping over (refer also to FIG. 13).

Road tests were conducted to determine the optimal dimensions of traffic warning device 20, wherein vehicle tires ran over traffic warning device 20 from various directions and speeds. The results of those tests showed that a width W of about 2.2 inches, a height H of about 1.4 inches, and a length L of about 16.2 inches produced optimal results.

A reflector 36 is disposed on first side 28 which preferably emits a red light when illuminated by a light source such as vehicle headlights. In a preferred embodiment, reflector 36 consists of three contiguous separately replaceable reflectors 36 of the many faceted prismatic lens type which form an elongated reflective surface. Also, other types of reflectors or reflective tape could be utilized, so long as the light from the headlights of the vehicle is reflected back to the driver. It is noted that reflector 36 can be turned away from being substantially perpendicular to the light source, either horizontally or vertically, and still reflect some light back to a driver. However, the further reflector 36 is away from perpendicular, the less light that will be reflected. In a preferred embodiment of the invention, reflectors 36 are recessed into first side 28 (refer to FIG. 4). In this fashion, reflectors 36 are somewhat protected from structural damage, abrasion, and the like.

Traffic warning device 20 further includes a selectively energizable red light 38 disposed on first side 28. Light 38 is particularly useful in warning vehicles without headlights or pedestrians of a road obstruction. In a preferred embodiment, light 38 is a red light emitting diode which is powered by a battery 39 connected in series with a current limiting resistor 41 (also refer to FIG. 6). A switch 40 for turning light 38 ON and OFF is disposed on second side 30. The housing for light 38, battery 39, and resistor 41 are contained within a cavity inside body 22 which is covered by an access panel (refer also to FIG. 9). If reflectors 36 should fail because a vehicle is approaching without its headlights, light 38 can work independently to warn motorist of an obstruction in the roadway 509.

A bright color such as international orange is disposed on second side 30. For daytime use, traffic warning device 20 is oriented so that second side 30 faces oncoming traffic and can be seen by motorists and pedestrians. Also in a preferred embodiment of the invention, second side 30 includes at least one recessed removable panel 42 (refer also to FIG. 9). The central panel 42 permits access to the components associated with red light 38. All panels 42 can be replaced when they start to show road wear from being run over, or start to weather and fade from the sun and the elements. Also referring to FIG. 9, at least one structural support member 44 is disposed within body 22 for supporting top 24 when a load from a tire 600 is applied. In the shown embodiment, structural support members 44 include a metal plate which is inserted into groves 46 in body 22.

A bright color such as international orange is also disposed upon top 24. This feature allows traffic warning device 20 to be clearly seen from the air.

When traffic warning device 20 is placed prone, bottom 26 down, upon the surface of a road 500, first 28 and second 30 sides form an elongate barrier which extends along the surface of the road 500. In this manner, traffic warning device 20 gives a driver the perception of a elongated horizontal barrier so that the device will be quickly and clearly noticed, allowing the driver time to steer away from the upcoming obstruction. A length L of about 16 inches has been found useful for this purpose. The horizontal barrier feature is particularly useful when a plurality of traffic warning devices 20 are placed end-to-end in established law enforcement patterns, to provide guidance to motorists and pedestrians to follow a certain direction of travel (refer also to FIGS. 14 and 15).

Figure 6:
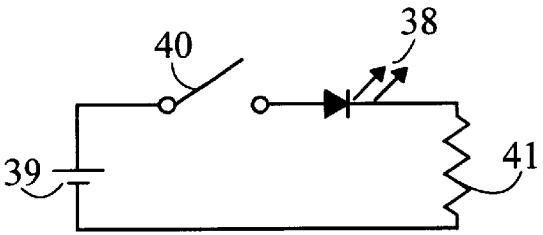
FIG. 6 is a circuit diagram.
Figure 5:
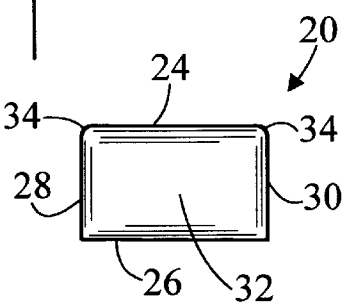
FIG. 5 is and end elevation view.

Referring now to FIG. 6, there is illustrated a circuit diagram for energizable light 38. The circuit includes light 38, which in a preferred embodiment is a light emitting diode (LED), 9 volt battery 39, switch 40, and resistor 41.

Figure 7:
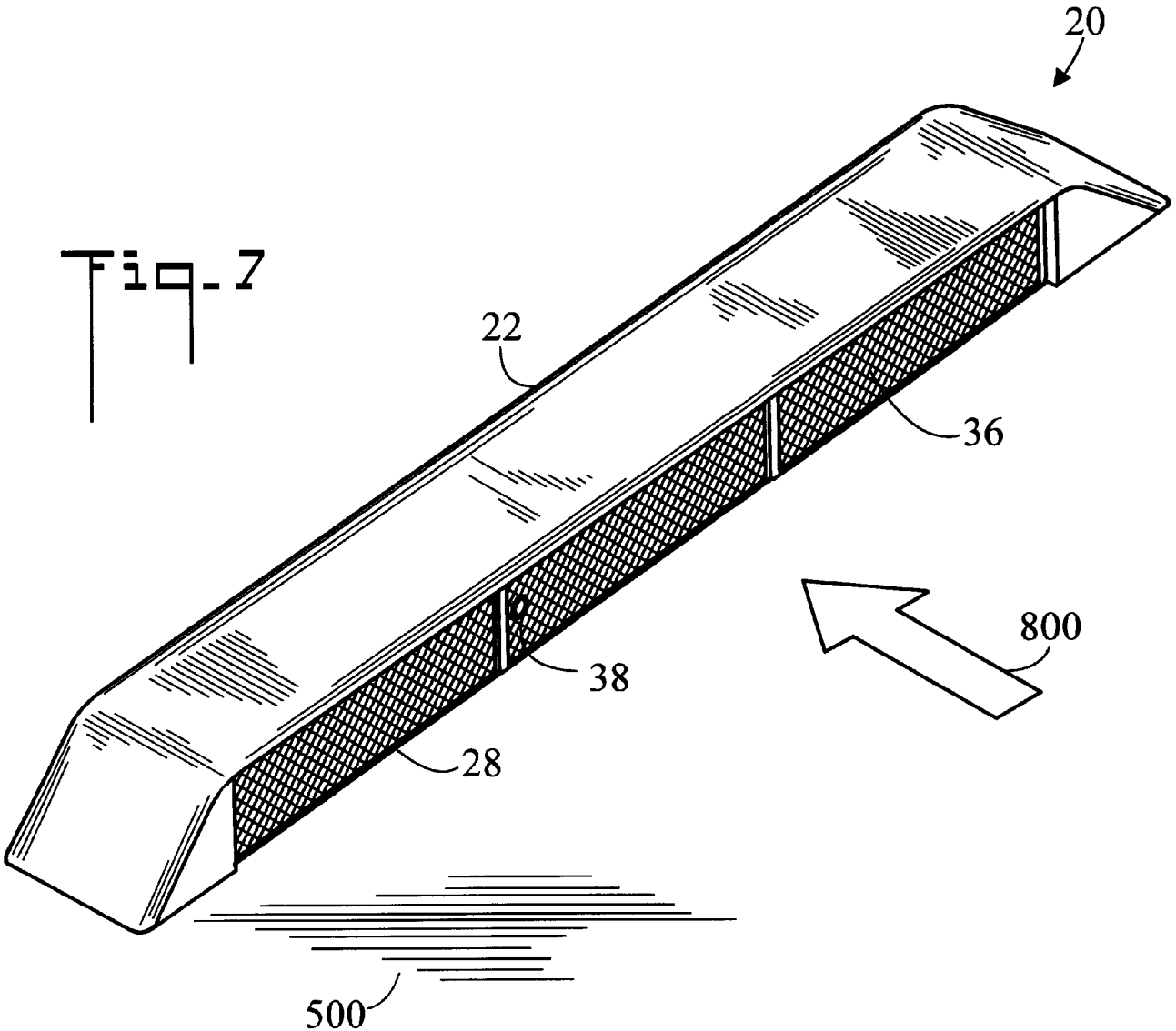
FIG. 7 is a perspective view of the traffic warning device placed on a road, showing the first side.
Figures 8, 9:
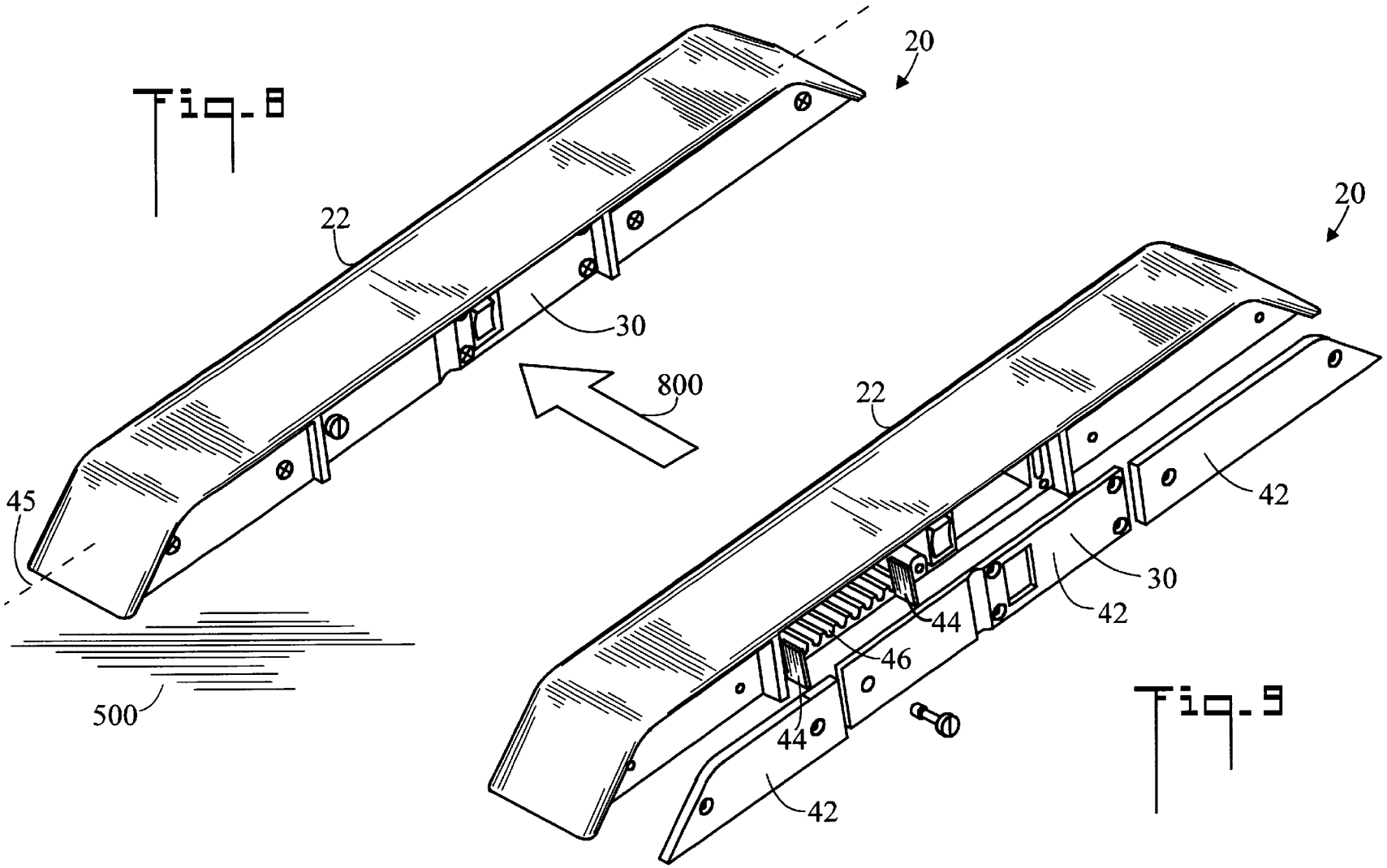
FIG. 8 is a perspective view of the traffic warning device placed on a road, showing the first second side.
FIG. 9 is an exploded perspective view of the traffic warning device, showing the removable panels of the second side.

FIGS. 7 and 8 are perspective views of traffic warning device 20 horizontally placed upon the surface of a road 500. Traffic warning device 20 is used to warn approaching traffic of a road obstruction by placing bottom 26 upon the surface of the road 500 in the vicinity of the obstruction, so that longitudinal axis 45 (also refer to FIG. 4) is substantially perpendicular to the direction of oncoming traffic 800. At night, traffic warning device 20 is oriented so that first side 28 faces the oncoming traffic (FIG. 7). Also at night, light 38 may be energized. In the daytime, traffic warning device 20 is oriented so that second side 30 faces the oncoming traffic. (FIG. 8)

FIG. 9 is an exploded perspective view of the traffic warning device .20, showing removable panels 42 of second side 30.

Figure 11:
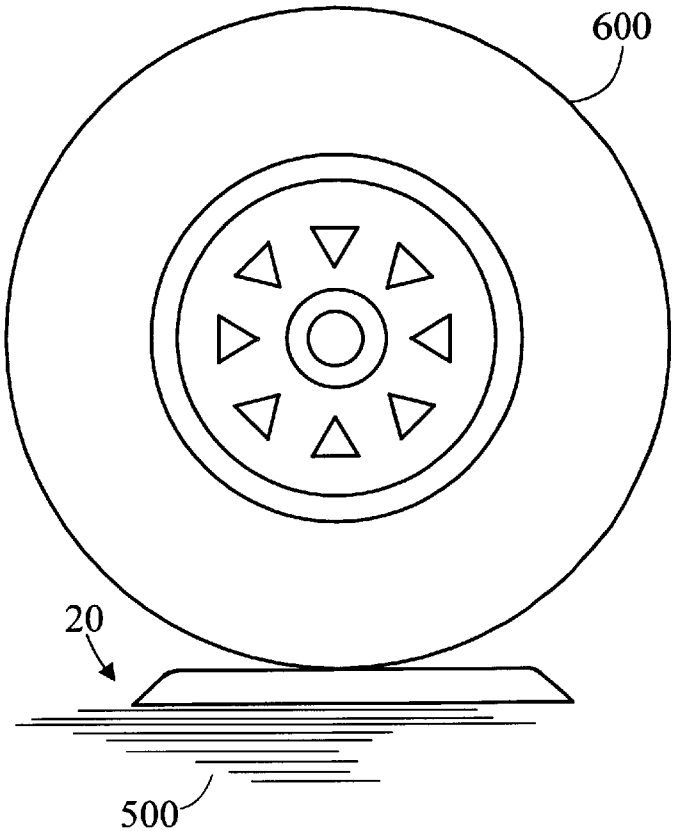
FIG. 11 is a reduced side elevation view of the tire rolling over the traffic warning device.
Figure 10:
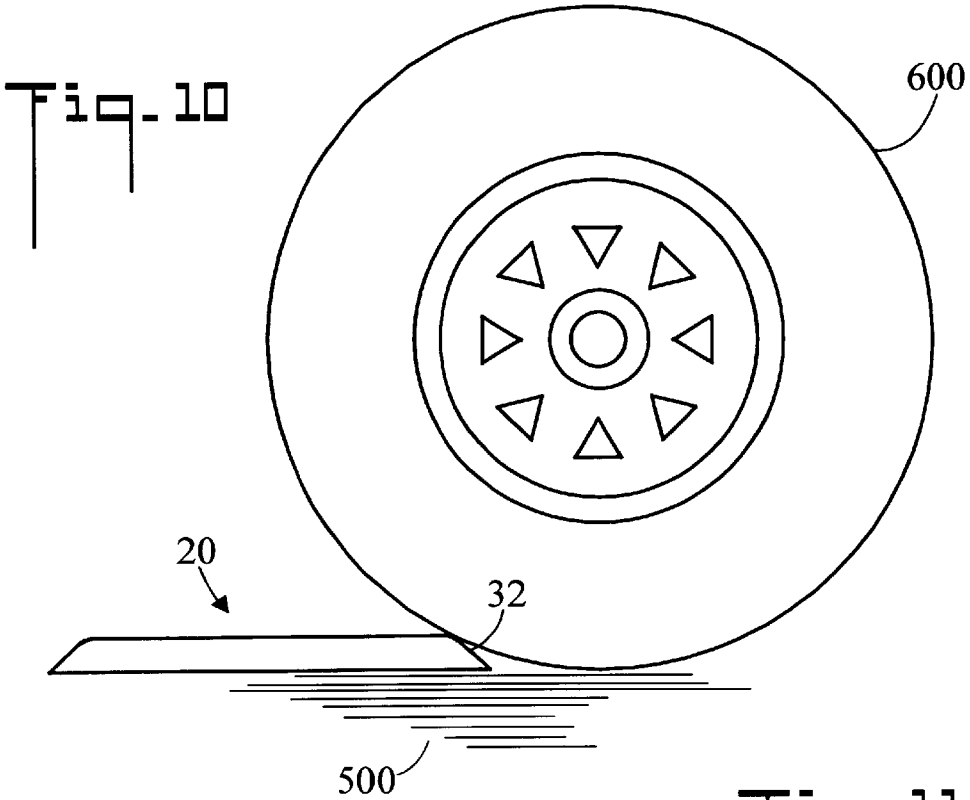
FIG. 10 is a side elevation view of a tire striking the end of the traffic warning device.

FIG. 10 is a side elevation view of a tire 600 striking the end 32 of the traffic warning device 20, and FIG. 11 is a reduced side elevation view of the tire 60 rolling over traffic warning device 20. Because ends 32 of traffic warning device 20 are beveled, tire 600 will tend to roll over traffic warning device leaving it in place, instead of causing the device to turn over or move.

Figure 12:
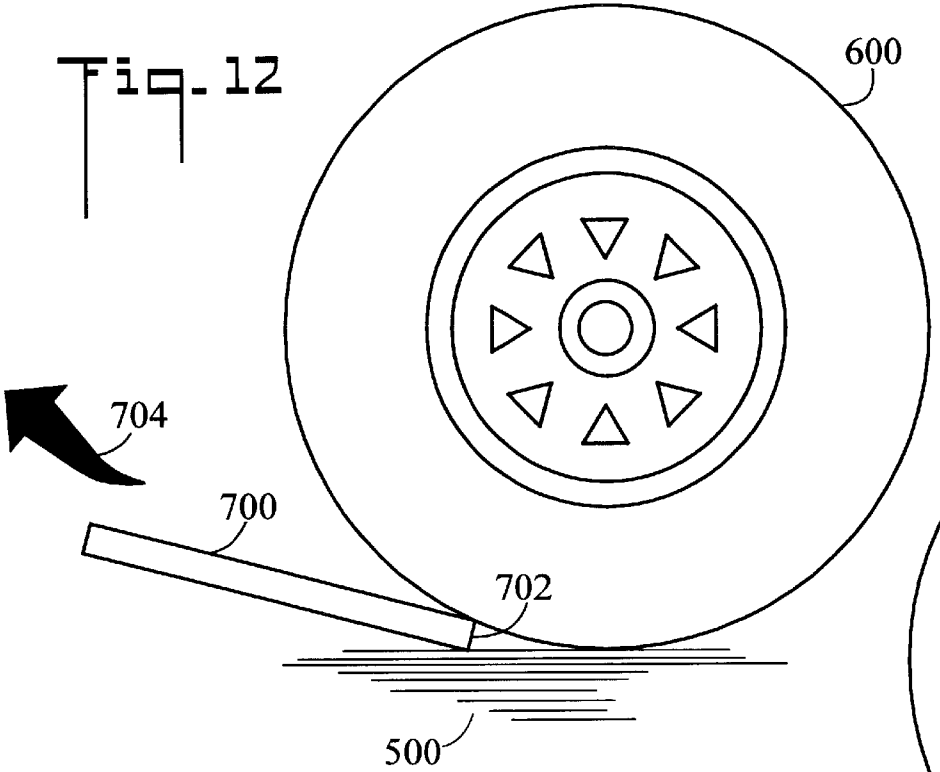
FIG. 12 is a reduced side elevation view of a tire striking the end of a square traffic warning device.

FIG. 12 is a reduced side elevation view of a tire 600 striking the end of a square traffic warning device 700. Because the end 702 of traffic warning device 700 is square, tire 600 can cause the device to tilt, turn over, or be projected in direction 704.

Figure 13:
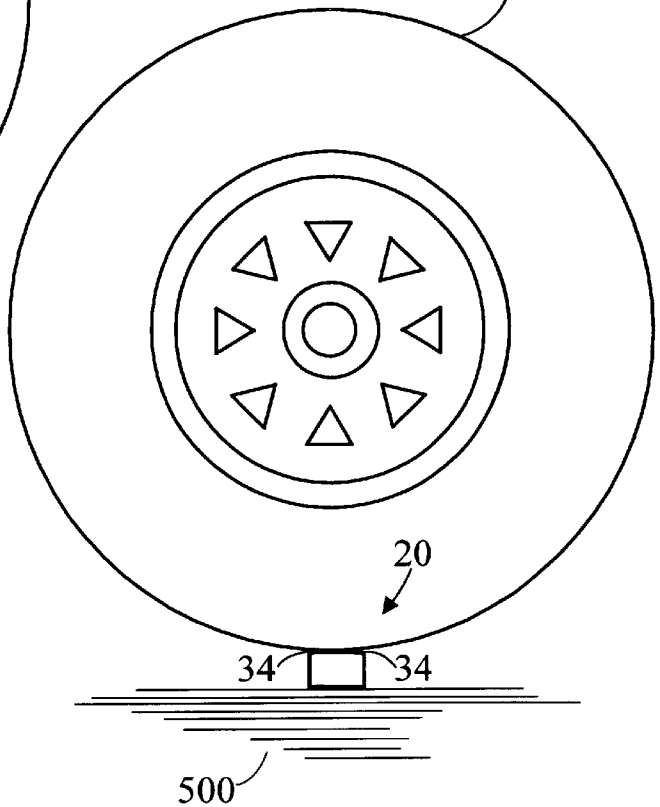
FIG. 13 is a reduced side elevation view of a tire striking the side of the traffic warning device.

FIG. 13 is a reduced side elevation view of a tire 600 striking the side of traffic warning device 20. Because edges 34 are rounded, tire 600 will tend to roll over traffic warning device 20 without disturbing it.

Figure 14:
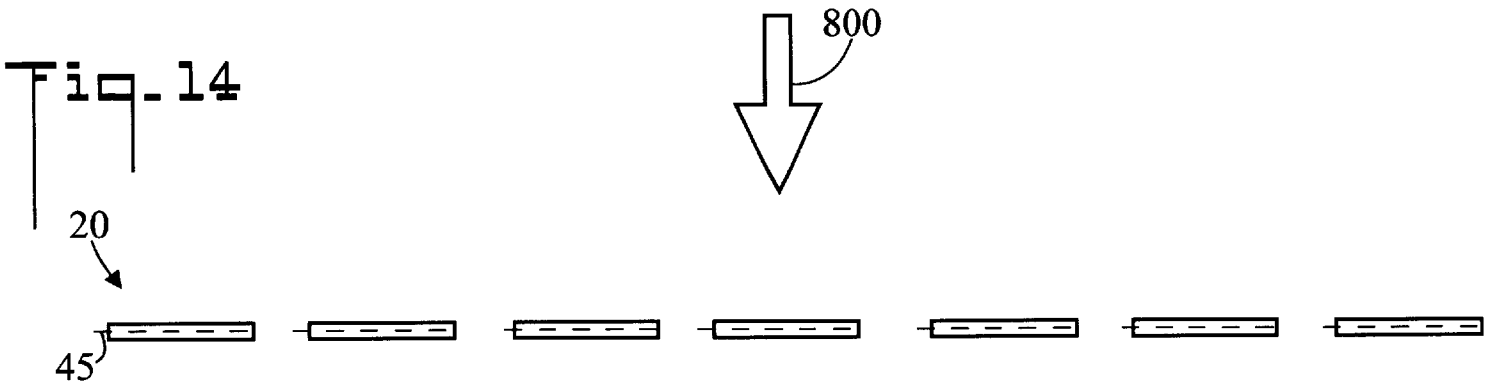
FIG. 14 is a reduced top plan view of a plurality of traffic warning devices arranged in coaxial relationship so as to form a barricade to oncoming traffic; and, FIG. 15 is a reduced top plan view of a plurality of traffic warning devices arranged so as to direct traffic in a desired direction.
Figure 15:
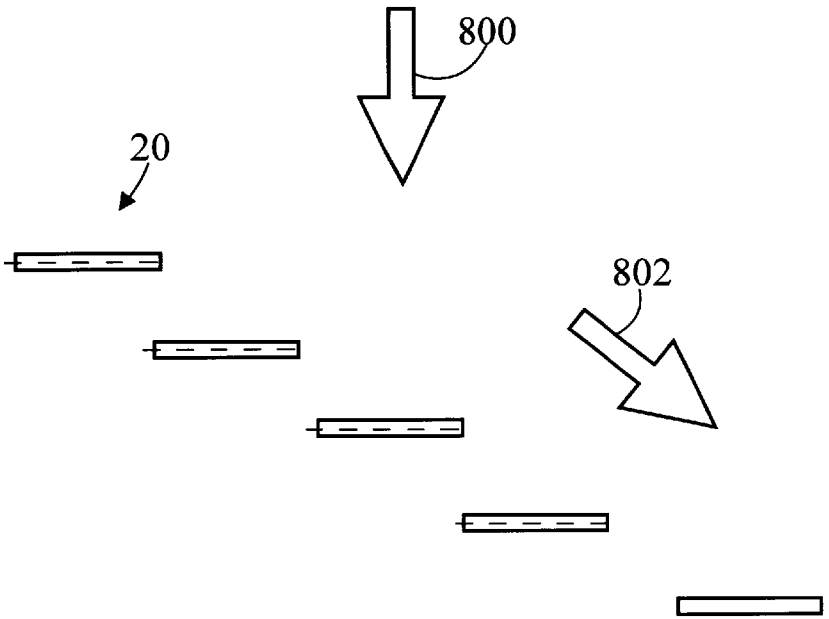

FIG. 14 is a reduced top plan view of a plurality of traffic warning devices 20 arranged in coaxial relationship so as to form a barricade to oncoming traffic 800. FIG. 15 is a reduced top plan view of a plurality of traffic warning devices 20 arranged so as to direct oncoming traffic 800 in a desired direction 802. A plurality of traffic warning devices 20 may be placed on the road 500 so that the longitudinal axes 45 of the devices are substantially co-linear to form a barricade (FIG. 14). Alternatively, a diagonal line to the left would direct traffic from right to left (FIG. 15), and a diagonal line to the right would direct traffic from left to right. Traffic warning device 20 can also be placed on the road 500 in two separate parallel lines to direct traffic into a single lane. Of course, because traffic warning device 20 is both portable and reusable, it may be placed and re-placed upon the road 500, and then removed and stored for use at another time.

In terms of construction, in a preferred embodiment, traffic warning device 20 is fabricated from a high strength polymer such as high density polyethylene. High compressive strength is necessary since vehicular traffic will occasionally run over the device. In a preferred embodiment, a bright coloring such as international orange or the like is added to the polymer, thereby resulting in the desired bright color. Because traffic warning device 20 is made of plastic, when worn out it may be recycled.

Resinol Type F® high density polyethylene is available from Allied Resinous Products, Inc. (subsidiary of Norton), P.O. Box 620 Clark & Whitney St., Conneaut, Ohio 44030. This product offers high tensile strength (up to 4,800 PSI), and −180° to +250° temperature performance.

Reflector 32 may be procured from Bargman Inc., 537 North Church, Tekonsha, Mich. 49092, as a Class "A" acrylic reflector, hermetically sealed, with an adhesive fiber back for instant mounting, P/N 70-71-180. Alternatively, red reflective tape can be procured from Reflexite, P.O. Box 1200, 315 South Street, New Britain, Conn. 06050.

In terms of use, a method of warning approaching traffic of a road obstruction, comprising the steps of:

(1) providing a traffic warning device 20 including an elongate 22 having a top 24, an opposite bottom 26, a first side 28, and opposite second side 30, a length L, a width W, a height H, two opposite beveled ends 32, the width W greater than the height H, a reflector 36 is disposed on first side 28, and a bright color is disposed on second side 30, the first side 28 and the second side 30 being substantially perpendicular to bottom 26;

(2) providing a road 500 having a surface and a direction of oncoming traffic 800;

(3) providing a road obstruction; and, (4) placing the bottom 26 of traffic warning device 20 upon the surface of the road 500 in the vicinity of the obstruction, so that longitudinal axis 45 is substantially perpendicular to the direction of oncoming traffic 800.

At night, in step (4) orienting traffic warning device 20 so that first side 28 faces the oncoming traffic 800.

Providing traffic warning device 20 with a selectively energizable light 38 disposed on first side 28, and during step (4) energizing light 38.

In the daytime, in step (4) orienting traffic warning device 20 so that second side 30 faces the oncoming traffic 800.

In step (4) placing a plurality of traffic warning devices 20 on the road 500, so that longitudinal axes 45 are substantially co-linear.

In step (4) placing a plurality of traffic warning devices 20 on the road 500, so that longitudinal axes 45 are substantially parallel but not co-linear.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A traffic warning device for temporary placement upon the surface of a road, comprising:

an elongated body having a top, an opposite bottom, a first side, and opposite second side, a length, a width, a height, and two opposite beveled ends, said beveled ends configured so that said bottom is larger than said top, so that when said beveled ends are run over by a tire, said traffic warning device will resist tipping over;

said width greater said height;

a reflector having a reflective surface disposed on said first side, and a bright color disposed on said second side;

said body having a longitudinal axis;

said first and second sides being perpendicular to said top and said bottom, so that said traffic warning device has a rectangular cross section perpendicular to said longitudinal axis;

so that when said traffic warning device is placed prone, said bottom down, upon the surface of the road, said first and second sides form an elongated barrier which extends along the surface of the road, wherein said reflective surface of said reflector is perpendicular to the surface of the road;

said traffic warning device specifically not designed for attachment to the surface of the road;

said width being about 2.2 inches;

said height being about 1.4 inches; and, said length being about 16.2 inches.

2. A traffic warning device for temporary placement upon the surface of a road, comprising:

an elongated body having a top, an opposite bottom, a first side, and opposite second side, a length, a width, a height, and two opposite beveled ends, said beveled ends configured so that said bottom is larger than said top, so that when said beveled ends are run over by a tire, said traffic warning device will resist tipping over;

said body having a longitudinal axis;

said width greater than said height;

a reflector having a reflective surface disposed on said first side, and a bright color disposed on said second side;

said first and second sides being perpendicular to said top and said bottom, so that said traffic warning device has a rectangular cross section perpendicular to said longitudinal axis;

so that when said traffic warning device is placed prone, said bottom down, upon the surface of the road, said first and second sides form an elongated barrier which extends along the surface of the road, wherein said reflective surface of said reflector is perpendicular to the surface of the road;

said traffic warning device specifically not designed for attachment to the surface of the road;

said top forming an edge with each of said first and second sides, said edges being rounded, so that when said traffic warning device is run over by a tire, said traffic warning device will resist tipping over;

at least one structural support member disposed within said body for supporting said top when a load from a tire is applied;

said reflector recessed into said first side;

a selectively energizable red light disposed on said first side;

said bright color being international orange;

said second side including at least one recessed removable panel, said panel providing access to electronic components disposed within said traffic warning device;

said width being about 2.2 inches;

said height being about 1.4 inches;

said length being about 16.2 inches;

when viewed from said first side, said bevel being about 45°;

said second side including at least one recessed removable panel; and, international orange disposed upon said top.

3. A traffic warning device for temporary placement upon the surface of a road, comprising;

an elongated body having a top, an opposite bottom, a first side, and opposite second side, a length, a width, a height, and two opposite beveled ends, said beveled ends configured so that said bottom is larger than said top, so that when said beveled ends are run over by a tire, said traffic warning device will resist tipping over;

a reflector having a reflective surface disposed on said first side, and a bright color disposed on said second side;

said first and second sides being perpendicular to said top and said bottom, so that said traffic warning device has a rectangular cross section perpendicular to said longitudinal axis; and, said height being about 1.4 inches.

* * * * *